US008961197B2

(12) United States Patent
Ferran Palau et al.

(10) Patent No.: US 8,961,197 B2
(45) Date of Patent: Feb. 24, 2015

(54) FUSE HOUSING ASSEMBLY

(71) Applicant: Lear Corporation, Southfield, MI (US)

(72) Inventors: Joan Ignasi Ferran Palau, Valls (ES); Antonio Tomas Amenos, Valls (ES); Antonio Palomo Lorenzo, Valls (ES)

(73) Assignee: Lear Corporation, Southfield, MI (US)

( * ) Notice: Subject to any disclaimer, the term of this patent is extended or adjusted under 35 U.S.C. 154(b) by 95 days.

(21) Appl. No.: 13/907,050

(22) Filed: May 31, 2013

(65) Prior Publication Data

US 2013/0330949 A1 Dec. 12, 2013

Related U.S. Application Data

(60) Provisional application No. 61/657,188, filed on Jun. 8, 2012.

(51) Int. Cl.

| | |
|---|---|
| ***H01R 12/00*** | (2006.01) |
| ***H01R 33/06*** | (2006.01) |
| ***H01H 85/20*** | (2006.01) |
| ***H01R 12/58*** | (2011.01) |

(52) U.S. Cl.
CPC ..... *H01R 33/06* (2013.01); *H01H 85/20* (2013.01); *H01R 12/58* (2013.01)
USPC ..... 439/76.2

(58) Field of Classification Search
CPC ..... H01R 2201/26; H01R 13/6658
USPC ..... 439/76.2, 76.1, 79, 80, 934
See application file for complete search history.

(56) References Cited

U.S. PATENT DOCUMENTS

| | | | | |
|---|---|---|---|---|
| 3,328,749 | A | 6/1967 | Kukla | |
| 5,199,896 | A * | 4/1993 | Mosquera | 439/329 |
| 5,444,428 | A * | 8/1995 | Carr et al. | 337/188 |
| 5,647,769 | A | 7/1997 | Takeuchi | |
| 6,089,918 | A | 7/2000 | Arakelian et al. | |
| 7,108,519 | B2 * | 9/2006 | Tomikawa et al. | 439/76.2 |
| 7,445,509 | B2 | 11/2008 | Korczynski | |
| 7,988,493 | B2 | 8/2011 | Taniguchi et al. | |
| 8,339,236 | B2 | 12/2012 | Okada | |
| 2005/0227552 | A1 * | 10/2005 | Yamashita et al. | 439/862 |
| 2008/0278276 | A1 | 11/2008 | Banzo | |
| 2010/0105222 | A1 * | 4/2010 | Miyamoto | 439/76.2 |

FOREIGN PATENT DOCUMENTS

| | | | |
|---|---|---|---|
| DE | 3022115 | C2 | 10/1985 |
| JP | 200083313 | A | 3/2000 |

OTHER PUBLICATIONS

German Office Action for corresponding Application No. 10 2013 210 626.2, mailed Feb. 4, 2014, 8 pages.

* cited by examiner

*Primary Examiner* — Tulsidas C Patel
*Assistant Examiner* — Phuongchi T Nguyen
(74) *Attorney, Agent, or Firm* — Brooks Kushman P.C.

(57) ABSTRACT

A fuse housing assembly is provided with a housing having a base adapted to be mounted to a printed circuit board (PCB) at least partially over a through aperture. The housing has at least one receptacle sized to receive a case-type fuse. The housing has an aperture in the base aligned with the at least one receptacle for receipt of a terminal blade from the PCB for electrical communication with the case-type fuse. At least one connector blade is mounted to the housing and extends into the at least one receptacle and extends through the base to extend through the PCB through aperture for electrical communication with the case-type fuse and the connector.

19 Claims, 2 Drawing Sheets

FUSE HOUSING ASSEMBLY

CROSS-REFERENCE TO RELATED APPLICATIONS

This application claims the benefit of U.S. provisional Application No. 61/657,188 filed Jun. 8, 2012, the disclosure of which is incorporated in its entirety by reference herein.

TECHNICAL FIELD

Various embodiments relate to fuse housing assemblies.

BACKGROUND

Conventionally, case-type fuses (such as J-Case, M-Case, and the like) are fuses with a pair of female terminals for receipt of a pair of male blade terminals. Typically, both blades are connected to a printed circuit board (PCB). One of the blades is typically connected to the feed connector, and the other to an output load. The fuse is employed to prevent excessive current from inadvertently being applied to wires connecting the output load.

SUMMARY

According to at least one embodiment, a fuse housing assembly is provided with a housing having a base adapted to be mounted to a printed circuit board (PCB) at least partially over a through aperture. The housing has at least one receptacle sized to receive a case-type fuse. The housing has an aperture in the base aligned with the at least one receptacle for receipt of a terminal blade from the PCB for electrical communication with the case-type fuse. At least one connector blade is mounted to the housing and extends into the at least one receptacle and extends through the base to extend through the PCB through aperture for electrical communication with the case-type fuse and the connector.

According to at least another embodiment, a fuse housing assembly is provided with a PCB having a through aperture and at least one female terminal adjacent the through aperture. A first housing has a base mounted to a first side of the PCB at least partially over the through aperture and at least partially over the at least one female terminal. The first housing has at least one receptacle sized to receive a case-type fuse. At least one first blade is received within the at least one female terminal and extends into the at least one receptacle of the first housing. A second housing is mounted to a second side of the PCB at least partially over the through aperture. The second housing has a receptacle sized to receive a connector. At least one second blade is mounted to the first housing and extends into the at least one receptacle of the first housing and extends through the PCB through aperture and into the second housing receptacle.

According to at least one embodiment, a fuse housing assembly is provided with a PCB having a through aperture and a plurality of female terminals adjacent the through aperture. A first housing has a base mounted to a first side of the PCB at least partially over the through aperture and at least partially over the plurality of female terminals. The first housing has a plurality of receptacles each sized to receive a case-type fuse. A plurality of terminal blades are each received within one of the female terminals and extend into one of the receptacles in the first housing. A second housing is mounted to a second side of the PCB at least partially over the through aperture. The second housing has a receptacle sized to receive a connector. A plurality of connector blades are each mounted to the first housing and extend into one of the plurality of receptacles of the first housing and extend through the PCB through aperture and into the second housing receptacle.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
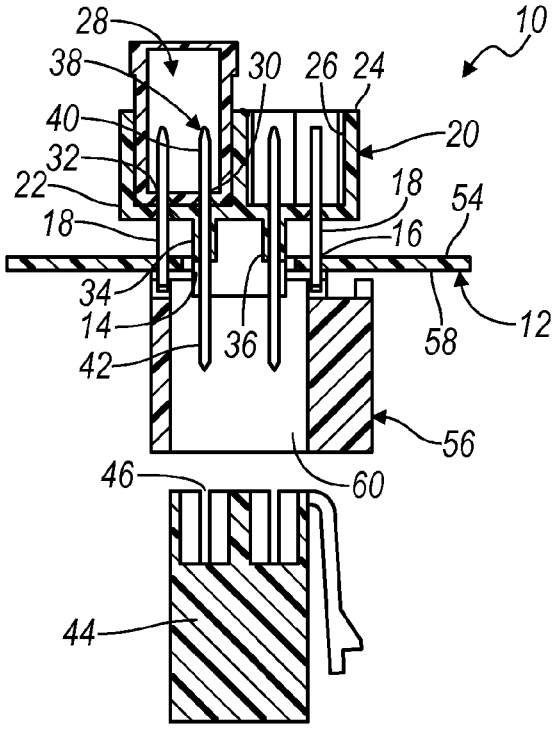
FIG. 1 is a partially exploded front side section view of a fuse housing assembly according to an embodiment.
Figure 2:
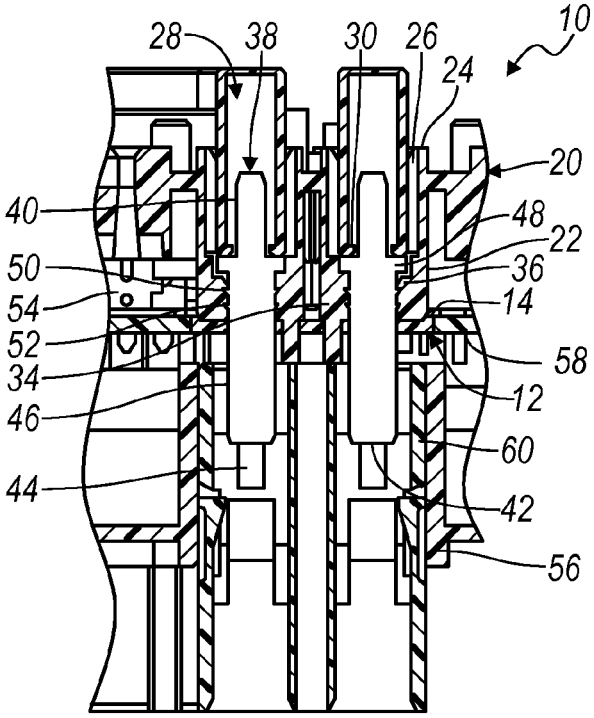
FIG. 2 is an enlarged partial right side section view of the fuse housing assembly of FIG. 1.
Figure 3:
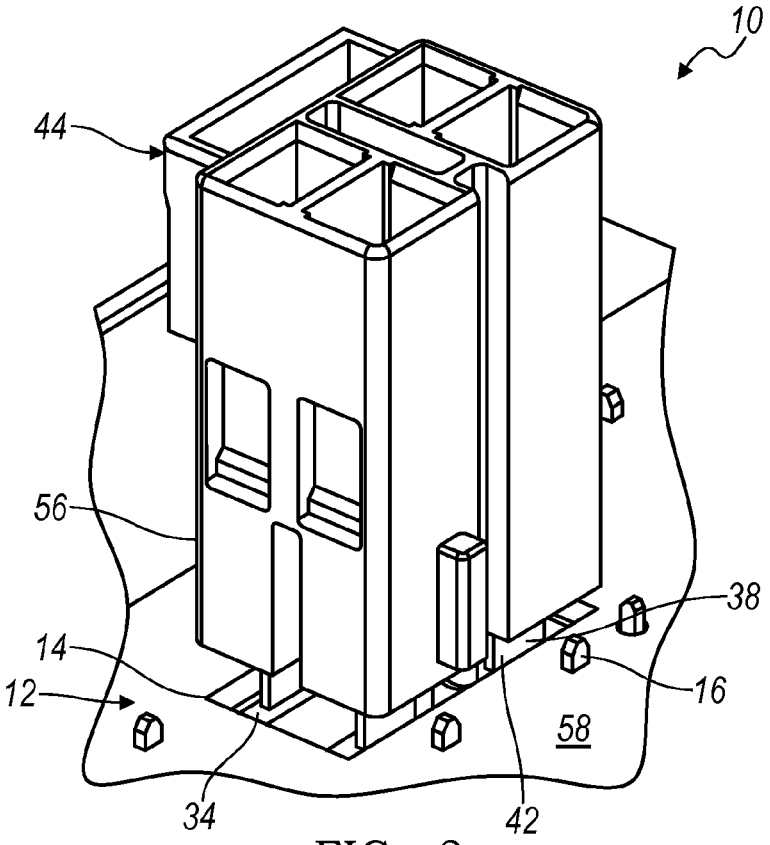
FIG. 3 is an enlarged partial perspective view of the fuse housing assembly of FIG. 1.

Referring now to FIGS. 1-3, a fuse housing assembly 10 is illustrated according to an embodiment. The fuse housing assembly 10 may be utilized in a junction box, according to an embodiment; and the fuse housing assembly 10 may be utilized in an automotive junction box. The fuse housing assembly 10 is provided for assembly with a printed circuit board (PCB) 12. The fuse housing assembly 10 may be offered separately than the PCB 12 in one embodiment. According to another embodiment, the fuse housing assembly 10 may include the PCB 12.

The PCB 12 includes a through aperture 14 and a plurality of female terminals 16 adjacent to the through aperture 14. A plurality of standard male terminal blades 18 are installed in the female terminals 16 for electrical communication with the PCB 12. The male blades 18 may be soldered to the female terminals 16 prior to assembly of the PCB 12 to the fuse housing assembly 10.

The fuse housing assembly 10 includes an upper housing 20 with a base 22 mounted to the PCB 12 over the through aperture 14 and the female terminals 16. A series of walls 24 extend from the base 22 providing a plurality of receptacles 26 that are each sized to receive a case-type fuse 28. The case-type fuses 28 each include a pair of female terminals 30 for receipt of male terminals. A terminal aperture 32 is formed in each receptacle 26, through the base 22 and aligned with one of the male blade terminals 18 for receipt through each terminal aperture 32 for connection in one of the female terminals 30 of each fuse 28.

The upper housing 20 may also include a boss 34 extending from the base 22 into the through aperture 14 of the PCB 12. A plurality of connector apertures 36 are formed through the base 22 and through the boss 34 within each receptacle 26. Each connector aperture 36 receives a connector blade 38 that extends into the receptacle 26 for electrical communication with the fuse 28, and which extends through the base 22, through the boss 34, and through the aperture 14 in the PCB 12.

Figure 4:
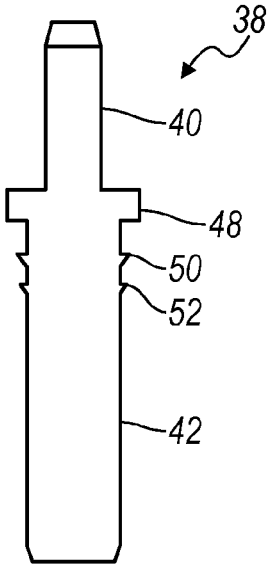
FIG. 4 is an enlarged side view of a connector blade of the fuse housing assembly of FIG. 1.

FIG. 4 illustrates the connector blade 38 in greater detail. Referring to FIGS. 1-4, the connector blade 38 is formed from a flat conductive material, and includes a first male blade 40 within the receptacle 26 for receipt within one of the female terminal 30 of the fuse for electrical connection with the fuse 28. The connector blade 38 also includes a second male blade 42 that extends through the PCB 12 for electrical connection with a connector 44. The second male blade 42 is sized to be received within a female terminal 46 of the connector 44, and for the particular embodiment, has a width greater than a width of the first male blade 40.

The connector blade 38 may be assembled to the upper housing 20, after the upper housing 20 is manufactured, such as by an injection-molding process. Thus, the connector blade 38 may include a shoulder 48 for limiting a depth of installation into the connector aperture 36. The connector blade 38 may also include a plurality of barbs 50, 52 for engaging the connector aperture 36 and retaining the connector blade 38 within the aperture 36. The connector blade 38 may be installed in the upper housing 20 prior to assembly to the PCB 12.

The upper housing 20 is mounted to one side 54, or an upper side 54, of the PCB 12. The word "upper" is a term of art in the context of fuse accessibility; and is also a relative term used for description in light of the drawings; and does not impose any limitations upon the claimed inventions. Referring again to FIGS. 1-3, the fuse housing assembly 10 also includes a second, or lower housing 56 mounted to a second side 58 of the PCB 12, over the through aperture 14.

The lower housing 56 has a receptacle 60 that is aligned with the upper housing 20 so that the second male blades 42 of the connector blade 38 extend into the receptacle 60. The receptacle 60 is sized to receive the connector 44. The fuse housing assembly 10 employs the connector blades 38 with double blade portions 40, 42 for a direct connection of the fuse 28 to a feed connector 44 without an additional connection through the PCB 12 as is common in the prior art. By eliminating intermediate connections, additional terminals are eliminated; consequently also eliminating an additional soldered connection. This improvement improves the effectiveness of the connection; reduces parts; reduces manufacturing steps; reduces the overall size; and reduces cost.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fuse housing assembly comprising:

a housing having a base adapted to be mounted to a primed circuit board (PCB) at least partially over a through aperture, the housing having at least one receptacle sized to receive a case-type fuse, the housing having an aperture in the base aligned with the at least one receptacle for receipt of a terminal blade from the PCB for electrical communication with the case-type fuse; and at least one connector blade mounted to the housing and extending into the at least one receptacle and extending through the base to extend through the PCB through aperture for electrical communication with the case-type fuse and the connector;

wherein the housing is further defined as a first housing adapted to be mounted to a first side of the PCB; and wherein the fuse housing assembly further comprises a second housing adapted to be mounted to a second side of the PCB at least partially over the through aperture, the second housing having a receptacle aligned with the first housing whereby the at least one connector blade extends into the second housing receptacle, the second housing receptacle being sized to receive a connector.

2. The fuse housing assembly of claim 1 wherein the at least one connector blade is formed from a flat conductive material.

3. The fuse housing assembly of claim 1 wherein the at least one connector blade comprises:

a first male blade for electrical connection with the fuse; and a second male blade for electrical connection with the connector, the second male blade having a width greater than the first male blade.

4. The fuse housing assembly of claim 1 wherein the at least one receptacle further comprises a plurality of receptacles, each sized to receive a case-type fuse;

wherein the housing has a plurality of apertures in the base each aligned with one of the plurality of receptacles for receipt of one of a plurality of blades from the PCB for electrical communication with the case-type fuse; and wherein the at least one connector blade comprises a plurality of connector blades, each mounted to the housing and extending into one of the plurality of receptacles and extending through the base to extend through the PCB through aperture for electrical communication with one of the case-type fuses and the connector.

5. The fuse housing assembly of claim 1 further comprising at least one case-type fuse received in the at least one receptacle.

6. The fuse housing assembly of claim 1 wherein the housing further comprises a boss extending from the base sized to be received within the through aperture of the PCB.

7. The fuse housing assembly of claim 6 wherein the housing includes at least one second aperture formed through the boss for installation of the at least one connector blade.

8. The fuse housing assembly of claim 1 wherein the housing includes at least one second aperture for installation of the at least one connector blade.

9. The fuse housing assembly of claim 8 wherein the at least one connector blade comprises at least one barb for retention of the at least one connector blade within the at least one second aperture.

10. The fuse housing assembly of claim 8 wherein the at least one connector blade comprises a shoulder to limit a depth of installation into the at least one second aperture.

11. The fuse housing assembly of claim 1 further comprising:

a PCB having a through aperture, and at least one female terminal adjacent the through aperture, wherein the housing is mounted to the PCB at least partially over the through aperture and at least partially over the at least one female terminal; and at least one terminal blade received within the at least one female terminal and extending into the at least one receptacle of the first housing for electrical communication with the female terminal and the case-type fuse.

12. The fuse housing assembly of claim 11 wherein the at least one terminal blade is soldered to the PCB.

13. The fuse housing assembly of claim 11 wherein the housing is further defined as a first housing mounted to a first side of the PCB; and wherein the fuse housing assembly further comprises a second housing mounted to a second side of the PCB at least partially over the through aperture, the second housing having a receptacle aligned with the first housing whereby the at least one connector blade extends into the second housing receptacle, the second housing receptacle being sized to receive a connector.

14. The fuse housing assembly of claim 13 further comprising a connector received within the receptacle of the second housing in electrical communication with the at least one connector blade.

15. A fuse housing assembly comprising:

a printed circuit board (PCB) having a through aperture, and at least one female terminal adjacent the through aperture;

a first housing having a base mounted to a first side of the PCB at least partially over the through aperture and at least partially over the at least one female terminal, the first housing having at least one receptacle sized to receive a case-type fuse;

at least one first blade received within the at least one female terminal and extending into the at least one receptacle of the first housing;

a second housing mounted to a second side of the PCB at least partially over the through aperture, the second housing having a receptacle sized to receive a connector; and at least one second blade mounted to the first housing and extending into the at least one receptacle of the first housing and extending through the PCB through aperture and into the second housing receptacle.

16. The fuse housing assembly of claim 15 wherein the at least one second blade comprises:

a first male blade portion for electrical connection with the fuse; and a second male blade portion for electrical connection with the connector, the second male blade portion having a width greater than the first male blade portion.

17. The fuse housing assembly of claim 15 wherein the first housing comprises a second aperture for installation of the at least one second blade.

18. A fuse housing assembly comprising:

a printed circuit board (PCB) having a through aperture, and a plurality of female terminals adjacent the through aperture;

a first housing having a base mounted to a first side of the PCB at least partially over the through aperture and at least partially over the plurality of female terminals, the first housing having a plurality of receptacles each sized to receive a case-type fuse;

a plurality of terminal blades each received within one of the female terminals and extending into one of the receptacles in the first housing;

a second housing mounted to a second side of the PCB at least partially over the through aperture, the second housing having a receptacle sized to receive a connector; and a plurality of connector blades each mounted to the first housing and extending into one of the plurality of receptacles of the first housing and extending through the PCB through aperture and into the second housing receptacle.

19. The fuse housing assembly of claim 18 wherein each of the plurality of connector blades comprise:

a first male blade for electrical connection with the fuse; and a second male blade for electrical connection with the connector, the second male blade having a width greater than the first male blade.

* * * * *

UNITED STATES PATENT AND TRADEMARK OFFICE

CERTIFICATE OF CORRECTION

PATENT NO. : 8,961,197 B2
APPLICATION NO. : 13/907050
DATED : February 24, 2015
INVENTOR(S) : Joan Ignasi Ferran Palau et al.

It is certified that error appears in the above-identified patent and that said Letters Patent is hereby corrected as shown below:

IN THE CLAIMS

Column 3, Line 51, Claim 1:

After "mounted to a"
Delete "primed" and
Insert -- printed --.

Signed and Sealed this
Eighth Day of March, 2016

Michelle K. Lee

Michelle K. Lee
*Director of the United States Patent and Trademark Office*